US005266432A

United States Patent [19]

Hayashi et al.

[11] Patent Number: 5,266,432

[45] Date of Patent: Nov. 30, 1993

[54] HYDROPHOBIC POLYESTER TONER COMPOSITION

[75] Inventors: Norihiro Hayashi; Eiji Morimoto; Kuniyasu Kawabe, all of Wakayama, Japan

[73] Assignee: Kao Corporation, Tokyo, Japan

[21] Appl. No.: 841,464

[22] Filed: Feb. 26, 1992

[30] Foreign Application Priority Data

Mar. 1, 1991 [JP] Japan ..... 3-061235
Mar. 1, 1991 [JP] Japan ..... 3-061236
Mar. 1, 1991 [JP] Japan ..... 3-061237

[51] Int. Cl.[5] ..... G03G 9/087
[52] U.S. Cl. ..... 430/109; 430/137
[58] Field of Search ..... 430/109, 99, 106, 137

[56] References Cited

U.S. PATENT DOCUMENTS 4,804,622 2/1989 Tanaka et al. ..... 430/109
4,977,054 12/1990 Honjo et al. ..... 430/108

FOREIGN PATENT DOCUMENTS 59-81650 5/1984 Japan .
59-231552 12/1984 Japan .
1-155360 6/1989 Japan .
1-155362 6/1989 Japan .
2-127657 5/1990 Japan .
2-225520 9/1990 Japan .

*Primary Examiner*—John Goodrow
*Attorney, Agent, or Firm*—Birch, Stewart, Kolasch & Birch

[57] ABSTRACT

The present invention is directed to a toner composition containing a polyester resin as a major component of a binder resin and 0.01 to 1.5 parts by weight of hydrophobic silica having a degree of hydrophobic property of not less than 80, and/or having a pH value of 5.5 to 8 when 4% by weight of hydrophobic silica is dispersed in water-methanol solution (1:1) to 100 parts by weight of the toner.

20 Claims, No Drawings

HYDROPHOBIC POLYESTER TONER COMPOSITION

BACKGROUND OF THE INVENTION

1. Field of the Invention

The present invention relates to a toner composition for development of an electrostatic image in the electrophotographic process, electrostatic recording process, electrostatic printing process and the like.

2. Discussion of Related Art

In development of an electrostatic latent image in electrophotography, toner particle size and toner particle size distribution are known to serve as important factors to obtain high resolution and high image quality.

When the particle size of a toner is reduced, the amount of pulverizing energy required increases as the size decreases, which generally leads to reduction in productivity and rise in cost; it is therefore necessary to use a resin with excellent fixing property and good pulverizability as the main component of the binder resin component of the toner.

However, it has been pointed out that even when the size of the toner is reduced while improving the pulverizing capability of the resin itself, the fluidity is reduced due to an increase in friction and aggregation of the toner particles and an increase in the ratio of water adhering to the surface of the toner particles under high humidity conditions, which results in a problem of reduction in developability accompanying reduction in the chargeability and transportability of the toner, because the surface area per unit weight of the toner increases.

Another problem has been pointed out that even when the particle size is reduced, the ratio of very fine particles having a particle diameter of not more than 5 μm increases and the particle size distribution broadens so that the uniformity in the electric charge of the toner is lowered.

To solve these problems, Japanese Patent Laid-Open Nos. 72054/1979 and 129437/1983 propose toners wherein the particle size distribution is controlled to reduce the number % of particles having a diameter of not more than 5 μm to suppress reduction in the fluidity and improve fluctuation in the amount of electric charge of the toner.

However, no satisfactory effect is obtained simply by reducing the number % of particles having a diameter of not more than 5 μm; fluidity and chargeability remain to be further improved.

Japanese Patent Laid-Open No. 284151/1990 proposes a toner containing toner particles having an average particle size of from 4 to 6 μm, being not less than 60 number % of toner particles which have a diameter of not more than 5 μm, and a fine powder of an inorganic compound. Although such a toner makes it possible to obtain a sharp image, it is reported that the amount of a fine powder of the inorganic compound added must be increased because the number % of toner particles having a diameter of not more than 5 μm is high.

Although various types of such fine powder of an inorganic compound are traditionally known, fine powder of silicone dioxide (silica) has been generally used to add and mix with the toner powder, as a surface treating agent.

However, because fine powder of silica is hydrophilic when it is directly used, it absorbs moisture from the air under high temperature and high humidity conditions, and this decreases the fluidity or causes aggregation of the toner particles. For this reason, it has been proposed to use silica fine powder treated by a hydrophobic treatment (See Japanese Patent Laid-Open Nos. 5782/1971 and 47345/1973). For example, a dimethyl substitution product has been known, in which a methyl group of a silane is bonded with silica by a reaction of dimethyldichlorosilane with hydrophilic silica (R-972: Nippon Aerosil Co., Ltd.).

However, the fine powder of silica is not hydrophobic enough even it has been treated to have a hydrophobic property. The aggregation property is noted at high temperature and high humidity and the fluidity of the toner is decreased. Thus, the degree of hydrophobic property has become an important issue.

Specifically, in the case of R-972, for example, the silanol group of the hydrophilic silica is substituted 70 to 80%, and the remaining 20 to 30% of silanol groups are not substituted and remain unchanged, and the degree of hydrophobicity is only 40.

Therefore, it has been pointed out that, when silica fine powder having such a degree of hydrophic property is used with the toner composition, it is difficult to stably form a great number of visible images with good quality for a long period by such a toner.

More recently, there have been several proposals to solve these problems. In one case the stable formation of a visible image with good quality in forming a great number of visible images for a long period can be obtained when hydrophobic silica fine powder having a hydrophobic index (i.e. a degree of hydrophobic property) of not less than 50, or more preferably not less than 65, which is obtained through a hydrophobic treatment of organic silicon compounds having a specific organic group, is added and mixed with toner powder in an amount of 0.01 to 15% by weight (Japanese Patent Laid-Open No. 81650/1984). A second proposal is to provide a toner containing 0.01 to 20% by weight of a hydrophobic silica fine powder obtained through a hydrophobic treatment, so that the degree of hydrophobicity is within the range of 30 to 80 (Japanese Patent Laid-Open No. 231552/1984).

Such a hydrophobic treatment has been used in methods already known, in which a chemical treatment is performed by an organic silicon compound reacting or physically adsorbing silica fine powder. In general, a method is adopted by which a treatment is performed by an organic silicon compound at the same time when or after silica fine powder obtained by a vapor phase oxidation of a silicon halogen compound has been treated by a silane coupling agent.

However, hydrophobic silica heretofore considered to show a high hydrophobic property has a hydrophobic degree of less than 80 at most, and actually those described in the above patent publication (Japanese Patent Laid-Open No. 231552/1984) has a hydrophobic degree of up to 74.

Japanese Patent Laid-Open No. 81650/1984 describes a compound with a degree of hydrophobic property of more than 65 as a high hydrophobic compound, whereas the upper limit is not clear, and it is not known exactly how high the hydrophobic property of the compound disclosed in the above patent publication is. The hydrophobic silica having a hydrophobic degree of less than 80, at best shows the improvements in electric charge retainability and fluidity compared with the conventional dimethyl substituted product having a hydrophobic degree of from 40 to 42. This was not sufficient for the purpose, however, under high temperature and high humidity conditions, because electric charge retainability and fluidity decreased and the stable formation of a visible image with good quality was hindered.

In the chase when the degree of hydrophobic property is not enough, a number of unreacted silanol groups remain in the hydrophobic silica or, in the case when the substitutents reacted with the silanol groups are small groups of atoms as a whole, a stable hydrogen bond is formed between the carboxyl group in the binder resin of the toner particles and moisture in the surroundings with the other unreacted silanol groups. As a result, the above stated problems arise under high temperature and high humidity conditions.

Therefore, whether the degree of hydrophobic property is high enough is determined by which kind of hydrophilic groups the binder resin has.

As the binder resin for toner, in general various types of resins are used including styrene type polymers such as polystyrene, styrene-butadiene copolymer, styrene-acrylic copolymer, etc., ethylene type polymers such as polyethylene, ethylene-vinyl acetate copolymer, etc., poly-(meth)acrylic acid esters, polyester resins, epoxy resins, and polyamide resin, etc. Of these resins for those having naturally high hydrophobic properties, such as normal styrene-acryl resin, a high degree of hydrophobic property will not be required of the silica. In the case of the polyester resin obtained by condensation polymerization of alcohol and carboxylic acid, because many carboxyl groups, which are hydrophilic groups, are contained in this resin, hydrogen bonds of such groups with water causes the decrease of electric charge retainability and fluidity of the toner. Thus, it has been pointed out that the degree of hydrophobic property is not sufficient.

Above all, when using a polyester resin as the major component of the binder resin of the toner and the toner size is reduced to obtain high resolution and high image quality, as described above, the surface area per unit weight of the toner increases, and the toner becomes more susceptible to the effect of moisture in the environment, which results in reduction in fluidity. For this reason, it is necessary to add a surface treating agent, such as hydrophobic silica fine powder, to obtain sufficient fluidity.

In such case, it is necessary to add a larger quantity of hydrophobic silica to maintain the fluidity of toner particles in the conventional type hydrophobic silica. For example, in the above patent publication (Japanese Patent Laid-Open No. 81650/1984), which describes the compound classified as a high hydrophobic compound group, with a hydrophobic index of 50 or more, it is proposed to add hydrophobic silica in an amount of 0.01 to 15% by weight. In the above patent publication (Japanese Patent Laid-Open No. 231552/1984) describing a compound with a hydrophobic index of 30 to 80, it is proposed to add hydrophobic silica in an amount of 0.01 to 20% by weight.

However, there remains the problems that, if the amount of hydrophobic silica is increased, the isolated silica causes damage to the surface of the photoconductor drum and the silica causes black spots as the initiator, even if the fluidity is maintained. The black spot is a type of filming on a photoconductor drum and it appears as black points on a visible image. Because the particles of hydrophobic silica are considerably hard, this phenomenon remarkably appears when a photoconductor drum used is a substance of relatively low hardness, such as a selenium-tellurium type or an organic photoconductor drum. Further, the same problem occurs even in the case of a selenium-arsenic type substance, which is relatively hard but is brittle to mechanical shock.

Another problem has been pointed out that when the additional amount of hydrophobic silica is great, the fluidity of toner tends to decrease because the moisture resistance of the hydrophobic silica is insufficient when used under high temperature and high humidity conditions.

Accordingly, it is preferred that the additional amount of hydrophobic silica be as low as possible, and it is also preferred to use such hydrophobic silica, which can improve electric charge retainability and fluidity of the toner by adding it in very small quantities.

On the other hand; a hydrophobic treatment of silica has been performed in the past through the use of volatile silanes in a reactor heated at about 400° C. For example, a method to utilized the thermal decomposition oxidizing reaction in a oxyhydrogen flame of silicon tetrachloride gas has been used, wherein the following reaction occurs:

$$SiCl_4 + 2\,H_2 + O_2 \rightarrow SiO_2 + 4\,HCl$$

In the meantime, because it is not very easy to remove hydrogen chloride generated during this reaction, it has been pointed out that the pH value of the hydrophobic silica thus obtained decreases to about 3 to 4, and problems such as the rusting on the inner wall of the tank for the hydrophobic silica-toner facilities during long-term use arises.

Specifically, the conventional hydrophobic silica obtained in the past had various problems such as the suitability of the degree of hydrophobic property and the amount to be added and, in addition to these problems, counter measures are urgently needed to improve the acidification condition of hydrophobic silica fine powder caused by a hydrogen chloride generated during treatment.

SUMMARY OF THE INVENTION

The object of the present invention is to provide a toner composition incorporating a polyester resin which is excellent in pulverizability and permits easy reduction in particle size as a toner binder resin, which reduction in the electric charge retainability and fluidity of the toner and which stably forms visible images with good quality without black spots even when a great number of visible images are formed for a long time.

With the aim of solving the problems described above, it has been determined that visible images having excellent properties such as freedom from the reduction in the electric charge retention and fluidity of the toner, can be formed by using hydrophobic silica fine powder subjected to a hydrophobic treatment to obtain a degree of hydrophobicity of not less than 80, and that fluidity and environmental resistance which have not been achieved by conventional methods can be ensured particularly for small toners having a particle size of 6 to 10 μm.

Specifically, the gist of the present invention relates to;

(1) a toner composition containing a polyester resin as a major component of the binder resin and 0.01 to 1.5 parts by weight of hydrophobic silica having a degree of hydrophobicity of not less than 80 wherein the degree is determined by a methanol titration test with 100 parts by weight of the toner, and (2) a toner composition containing a polyester resin as a major component of the binder resin and 0.01 to 1.5 parts by weight of hydrophobic silica having a pH value of 5.5 to 8, when 4% by weight of hydrophobic silica is dispersed in a water-methanol solution (1:1) to 100 parts by weight of the toner.

The polyester resin in the present invention is exemplyfied as the following three modes.

(1) The first mode,

A polyester resin obtained by the co-condensation polymerization of:

(i) a diol component represented by the general formula (1)

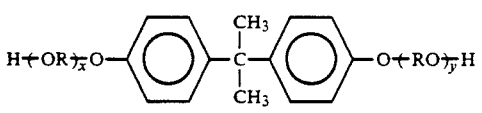

(1)

(wherein R represents an ethylene or propylene group, x and y are each an integer of 1 or more, and the average value of x+y is 2 to 7)

in an amount of not less than 10 mol % and not more than 30 mol % based on the entire monomer content;

(ii) a diol component represented by the general formula (2)

$$OH\leftarrow CH_2\rightarrow_n OH \quad (2)$$

(wherein n is an integer of 2 to 6)

in an amount of not less than 10 mol % and less than 25 mol % based on the entire monomer content;

(iii) a dibasic carboxylic acid, an anhydride thereof, or a lower alkyl ester thereof; and (iv) a tribasic or higher polybasic carboxylic acid, an anhydride thereof or a lower alkyl ester thereof in an amount of not less than 2.5 mol % and less than 15 mol % based on the entire monomer content.

(2) The second mode a polyester resin obtained by co-condensation polymerization of:

(i) a diol component represented by the general formula (1)

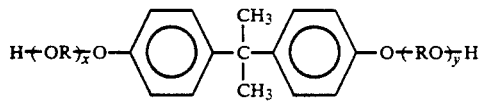

(1)

(wherein R represents an ethylene or propylene group, x and y are each an integer of 1 or more, and the average value of x+y is 2 to 7)

in an amount of less than 10 mol % based on the entire monomer content;

(ii) a diol component represented by the general formula (2)

$$OH\leftarrow CH_2\rightarrow_n OH \quad (2)$$

(wherein n is an integer of 2 to 6)

in an amount of not less than 10 mol % and less than 25 mol % based on the entire monomer content;

(iii) a dibasic carboxylic acid, an anhydride thereof, or a lower alkyl ester thereof;

(iv) a tribasic or higher polybasic carboxylic acid, an anhydride thereof, or a lower alkyl ester thereof in an amount of not less than 2.5 mol % and less than 15 mol % based on the entire monomer content; and further if necessary, (v) a diol component represented by the general formula (3)

$$OH\leftarrow R'O\rightarrow_n OH \quad (3)$$

(wherein R' represents an alkylene group having a carbon number of 2 to 4 and n is an integer of 2 to 4)

in an amount of not less than 1.5 mol % and less than 10 mol % based on the entire monomer content.

(3) The third mode,

A polyester resin obtained by co-condensation polymerization of a linear or branched polyester having a number-average molecular weight of 300 to 1400, a tribasic or higher polybasic carboxylic acid or a derivative thereof and/or a trihydric or higher polyhydric alcohol, wherein a diol component represented by the general formula (2):

$$OH\leftarrow CH_2\rightarrow_n OH \quad (2)$$

(wherein n is an integer of 2 to 6)

is used as a dihydric alcohol in an amount of not less than 10 mol % and less than 25 mol % based on the entire monomer content.

DETAILED DESCRIPTION OF THE INVENTION

The polyester resin of the first and second modes used as a major component of a binder resin can be prepared by the condensation polymerization between an alcoholic component and a carboxylic component such as a carboxylic acid, an ester thereof or an anhydride thereof. Examples of the diol component (i) include polyoxypropylene(2.2)-2,2-bis(4-hydroxyphenyl)-propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)-propane and the like. The value of e.g. (2.2) means the average of x and y.

Examples of the diol component (ii) according to the first and second modes include ethylene glycol, 1,3-propylene glycol, 1,4-butanediol, 1,5-pentanediol and 1,6-hexanediol, with preference given to ethylene glycol, 1,3-propylene glycol and 1,4-butanediol.

The diol component of (ii) is used in an amount of not less than 10 mol % and less than 25 mol % based on the entire monomer content. If it is less than 10 mol %, the lowest fixing temperature of toner will increase, and if it is not less than 25 mol %, the resin will become crystalline; these levels are therefore undesirable as described in Japanese Patent Examined Publication No. 493/1982.

When appropriate, the other diols such as diethylene glycol, triethylene glycol, 1,2-propylene glycol, neopentyl glycol, 1,4-butenediol or other dihydric alcohols such as bisphenol A and hydrogenated bisphenol A may be further added.

Examples of the carboxylic component (iii) according to the first and second modes include maleic acid, fumaric acid, citraconic acid, itaconic acid, glutanonic acid, phthalic acid, isophthalic acid, terephthalic acid, cyclohexanedicarboxylic acid, succinic acid, adipic acid, sebacic acid, azelaic acid, malonic acid, with preference given to maleic acid, fumaric acid, phthalic acid, isophthalic acid, terephthalic acid and succinic acid. Further, there are an alkylsuccinic acid or a alkenylsuccinic acid such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid and tetrapropenylsuccinic acid. Anhydrides thereof, a lower alkyl ester thereof and other dibasic carboxylic acids may be used.

According to the present invention, the tribasic or higher polybasic carboxylic acid or derivatives thereof (iv) serve to inhibit the offset phenomenon. If the amount of such carboxylic component is too small, little effect will be attained. On the contrary, if the amount is too large, the control of the reaction will be so difficult that a polyester resin having a consistent performance will be difficultly obtained and the obtained resin will be too hard to be easily pulverized, so that unfavorable phenomena such as the remarkable reduction in production efficiency of a toner or increase in the lowest fixing temperature will occur. Accordingly, the amount of the tribasic or higher polybasic carboxylic acid or a derivative thereof (iv) to be used is preferably in an amount of not less than 2.5 mol % and less than 15 mol % based on the entire monomer content. Examples of a tribasic or higher polybasic carboxylic acid or a derivative thereof (iv) include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Empol trimer acid, an anhydride thereof, a lower alkyl ester thereof and other tribasic or higher polybasic carboxylic acids, with preference given to 1,2,4-benzenetricarboxylic acid, the anhydride thereof and a lower alkyl ester thereof.

Examples of the diol component (V) according to the second mode include diethylene glycol, triethylene glycol, tetraethylene glycol, dipropylene glycol, tripropylene glycol, tetrapropylene glycol, di-tetramethylene glycol, tri-tetramethylene glycol and tetra-tetramethylene glycol.

The diol component of (v) is used in an amount of not less than 1.5 mol % and less than 10 mol % based on the entire monomer content. If it is less than 1.5 mol %, no rising effect on the fixing intensity will be obtained, and if it is not less than 10 mol %, toner blocking will occur. These levels are therefore undesirable.

In the third mode, the preferred character of the present invention is enhanced by using a dibasic carboxylic acid or a derivative thereof in an amount of not less than 1 mol % and not more than 25 mol % based on the entire monomer content, having a structure represented by the following general formula (4)

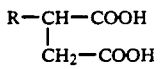

(4)

(wherein R represents a saturated or unsaturated hydrocarbon group with a carbon number of 4 to 20)

as the acid component constituting the branched polyester.

The polyester resin in the third mode is produced using a tribasic carboxylic acid or higher polybasic carboxylic acid monomer. The number-average molecular weight of the polyester polymerized after the tribasic carboxylic acid and higher polybasic carboxylic acid monomers out of the polyester-constituting monomers are previously eliminated is preferably not less than 300 and not more than 1400 from the view point of improvement in the pulverizability of the polyester. If the number-average molecular weight of this linear or branched polyester is less than 300, the amount of the tribasic carboxylic acid and higher polybasic carboxylic acid monomers must be not less than 15 mol % based on the entire monomer content, and this is undesirable from the reason described below. If the number-average molecular weight exceeds 1400, the pulverizability of the polyester resin polymerized in the presence of the tribasic carboxylic acid and higher polybasic carboxylic acid monomers will worsen, which is undesirable.

When the polyester has been produced using a dibasic carboxylic acid and/or an acid anhydride and a dihydric alcohol, its number-average molecular weight can be calculated from the number of terminal groups as follows.

$$\text{Number-average molecular weight} = \frac{2 \times 56.1 \times 1000}{\text{acid value (KOH mg/g)} + \text{hydroxyl group value (KOH mg/g)}}$$

With respect to the polyester obtained by an ester exchange reaction, its number-average molecular weight can be calculated by the known GPC method based on polystyrene conversion under the following conditions.

GPC conditions

Dectector: SYODEX RI SE-51, Column: A-80M,
Solvent: THF, Sample: 0.5% THF solution,
Injection volume: 0.1 ml,
Flow rate: 1.0 ml/min,
Effluent temperature: 40° C.,
Effluent pressure: 40 kg/cm$^2$ In a system containing tribasic carboxylic acid and higher polybasic carboxylic acid monomers, the number-average molecular weight of the polyester polymerized after the tribasic carboxylic acid and higher polybasic carboxylic acid monomers are previously eliminated can be set in the range from 300 to 1400 by increasing the mol % of the tribasic carboxylic acid and higher polybasic carboxylic acid monomers in the original monomer composition or introducing an additional low molecular substance into the dibasic carboxylic acid monomer.

The polyester resin of the third mode used as a major component of a binder resin can be prepared by the condensation polymerization between an alcoholic component and a carboxylic component such as a carboxylic acid, an ester thereof or an anhydride thereof. Examples of the diol component represented by the general formula (2) include ethylene glycol, 1,3-propylene glycol, 1,4-butanediol, 1,5-pentanediol and 1,6-hexanediol, with preference given to ethylene glycol, 1,3-propylene glycol and 1,4-butanediol.

The diol component is used in an amount of not less than 10 mol % and less than 25 mol % based on the entire monomer content. If it is less than 10 mol %, the lowest fixing temperature of toner will increase, and if it is not less than 25 mol %, the resin will become crystalline; these levels are therefore undesirable as described in Japanese Patent Examined Publication No. 493/1982.

When appropriate, the other diols such as diethylene glycol, triethylene glycol, 1,2-propylene glycol, neopentyl glycol, 1,4-butenediol, 1,4-cyclohexanedimethanol, polyoxypropylene(2.2)-2,2-bis-(4-hydroxyphenyl)propane, polyoxypropylene(3.3)-2,2-bis-(4-hydroxyphenyl)propane, polyoxyethylene(2.0)-2,2-bis-(4-hydroxyphenyl)propane, polyoxypropylene(6)-2,2-bis(4-hydroxyphenyl)propane, or other dihydric alcohols such as bisphenol A and hydrogenated bisphenol A may be further added.

Examples of the trihydric or higher polyhydric alcohol component in the third mode include sorbitol, 1,2,3,6-hexanetetrol, 1,4-sorbitan, pentaerythritol, tripentaerythritol, 1,2,4-butanetriol, 1,2,5-pentanetriol, glycerol, diglycerol, 2-methyl-1,2,4-butanetriol, trimethylolethane, trimethylolpropane, 1,3,5-trihydroxybenzene and other trihydric or higher polyhydric alcohols, with preference given to pentaerythritol, trimethylolethane and trimethylolpropane.

Examples of carboxylic acid component in the third mode include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and an anhydride thereof and a lower alkyl ester thereof, with preference given to maleic acid, fumaric acid, phthalic acid, isophthalic acid, terephthalic acid and succinic acid. Further, the dibasic carboxylic acid represented by the general formula (4) such as n-butysuccinic acid, n-butenylsuccinic acid, isobutylsuccinic acid, isobutenylsuccinic acid, n-octylsuccinic acid, n-octenylsuccinic acid, isooctylsuccinic acid, isooctenylsuccinic acid, n-dodecylsuccinic acid, n-dodecenylsuccinic acid, isododecylsuccinic acid, isododecenylsuccinic acid, and an anhydride thereof and a lower alkyl ester thereof can be used in combination with the above described carboxylic acid component, or can be used in place of them to lower the lowest fixing temperature without lowering of offset occuring temperature.

Examples of a tribasic or higher polybasic carboxylic acid component in the third mode include 1,2,4-benzenetricarboxylic acid (trimellitic acid), 1,2,5-benzenetricarboxylic acid, 2,5,7-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Empol trimer acid, and an anhydride thereof and a lower alkyl ester thereof, and other tribasic or higher polybasic carboxylic acids, with preference given to 1,2,4-benzenetricarboxylic acid, the anhydride thereof and a lower alkyl ester thereof.

Terephthalic acid or a lower alkyl ester thereof is preferably used a dibasic carboxylic acid other than the carboxylic acid represented by the general formula (4).

According to the present invention, the polyfunctional monomer having at least three functional groups of the third mode serves to inhibit offset phenomenon. If the amount of the polyfunctional monomer is too small, little effect will be attained. On the contrary, if the amount is too large, the control of the reaction will be so difficult that a polyester resin having a consistent performance will be difficultly obtained and the obtained resin will be too hard to be easily pulverized, so that unfavorable phenomena such as remarkable reduction in production efficiency of a toner or increase in the lowest fixing temperature will occur. Accordingly, the amount of the polyfunctional monomer having at least three functional groups is preferably in an amount of not less than 2.5 mol % and less than 15 mol %.

It is preferred that the binder resin containing the above polyester resin of these three modes as a major component has a softening point of 106° C. to 160° C., and a glass transition temperature of 50° C. to 80° C. If the softening point is less than 106° C., no sufficiently wide non-offset window will be attained, while if it exceeds 160° C., unfavorable phenomena such as increase in the lowest fixing temperature will occur. On the other hand, if the glass transition temperature is less than 50° C., a toner containing such a binder will exhibit a poor storage stability, while if it exceeds 80° C., the fixing ability will be adversely affected, which is unfavorable.

A polyester resin of the first, second and third modes in the present invention can be prepared by co-condensation polymerization of polyfunctional carboxylic acid component and polyol component at a temperature of 180° to 250° C. in an inert gas atmosphere. In this preparation, an esterification catalyst commonly used such as zinc oxide, stannous oxide, dibutyltin oxide and dibutyltin dilaurate may be used to accelerate the reaction. Alternatively, it may also be prepared under a reduced pressure for the same purpose.

A polyester resin thus obtained in the present invention is excellent in pulverizability.

The polyester resin of the present invention is used as the major component of the binder resin of the toner composition. The binder resin may further contain other resins such as a styrene or styrene-acrylate resin having a number-average molecular weight of not more than 11,000 in an amount of not exceeding 30% by weight in the binder resin to enhance the pulverizability for producing a toner. In preparing a toner, a characteristic improving agent such as wax is added as offset inhibitors. When the polyester resin according to the present invention is used as a binder resin, there is no need to add the above characteristic improving agent, or even if they are added, the amount thereof may be smaller.

The hydrophobic silica used in the present invention is obtained by a treatment with an organic silicon compound having an organic group such as a trialkyl group. More concretely, it can be obtained by a treatment with hexamethyldisilazane, trimethylchlorosilane or polydimethylsiloxane, and the degree of the hydrophobic property determined by the methanol titration test is not less than 80. For example, the substance having a degree of hydrophobic property of about 80 to 110 is used.

Here, a degree of hydrophobic property is the value obtained as follows:

In a beaker having a volume of 200 ml, 50 ml of pure water is placed and 0.2 g of silica is added. While stirring with a magnetic stirrer so gently that water surface is not recessed, methanol is dropped from a burette, the tip of which is immersed in water. The amount of the dropped methanol (in ml) until the floating silica begins to sink is regarded as the degree of hydrophobic property. In this case, methanol has surface active effect, and the floating silica is dispersed into water (i.e. it begins to sink) through methanol when methanol is dropped. Therefore, the higher degree of hydrophobic property (i.e. the more amount of methanol is dropped) means the more hydrophobic property of the silica.

As an organic silicon compound used in this treatment to increase hydrophobic property, an organic silicon compound having a trialkylsilyl group are normally used. Examples of the compound include hexamethyldisilazane, trimethylsilane, trimethylchlorosilane, trimethylethoxysilane, triorganosilymercaptan, trimethylsilylmercaptan, triorganosilylacrylate, hexamethyldisiloxane, and polydimethylsiloxane which has 2 to 12 siloxane units per molecule and contains hydroxyl group bonded with Si each at the unit located on the terminal end, with preference given to haxamethyldisilazane, trimethylchlorosilane and polydimethylsiloxane. Other silicon compounds such as vinyldimethylacetoxysilane, dimethylethoxysilane, dimethyldimethoxysilane, 1,3-divinyltetramethyldisiloxane and 1,3-diphenyltetramethyldisiloxane may also be used. These substances are used alone or as a mixture of two or more substances.

The hydrophobic silica in the present invention has a pH value of 5.5 to 8 when 4% by weight of hydrophobic silica is dispersed in a water-methanol solution (1:1). This is because the hydrophobic silica in the present invention has a higher degree of hydrophobic property in the entire surface. In the conventional type hydrophobic silica treated with a silicon halogen compound such as dimethylchlorosilane, methyltrichlorosilane and trimethylchlorosilane, hydrogen chloride is generated during the reaction and it remained by about 0.05% without being completely removed. Thus, it has a low pH value. However, in case of hydrophobic silica treated with hexamethyldisilazane, trimethylchlorosilane or polydimethylsiloxane in the present invention, hydrogen chloride is not generated and the above problem does not occur. While treating with hexamethyldisilazane, ammonia is generated in the reaction and the hydrophobic silica thus obtained shows a higher pH value due to alkalinity of ammonia itself.

The hydrophobic silica having such property can be easily produced by those skilled in the art by means of the above method. As the commercially available product, H-2000 by Wacker Chemicals East Asia Limited (degree of hydrophobic property 80; pH 7), TS-720 by Cabot Corporation (degree of hydrophobic property 80; pH 5.8) and Ts-530 by Cabot Corporation (degree of hydrophobic property 110; pH 6.0) can be used.

The conventional type hydrophobic silica as described above, for example R-972 manufactured by Nippon Aerosil Co. Ltd., which is a dimethyl substitution product, is assumed to have the following structure on the surface.

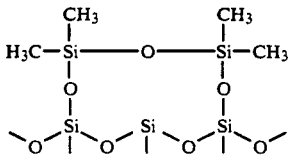

(toner side)
(R-972)

In contrast to this, H-2000 seems to have the structure as shown below. H-2000 has been manufactured to reduce the remaining quantity of a silanol group on the surface of a silicon compound to about 5% or below by promoting the reaction of hexamethyldisilazane to be used for increasing the hydrophobic property:

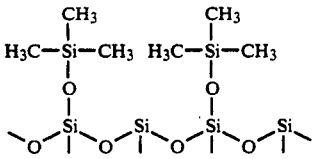

(toner side)
(H-2000)

TS-720 is obtainable by a treatment with polydimethylsiloxane and it seems to have the following structure:

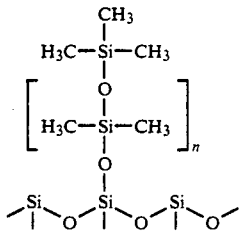

(TS-720)

TS-530 seems to have the following structure, which is obtainable by a treatment with hexamethyldisilazane:

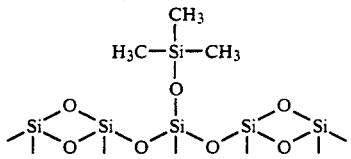

(TS-530)

It is preferred that hydrophobic silica fine power as described above has an average particle size of 0.003 μm to 2 μm, more preferably 0.005 μm to 0.5 μm. A specific surface area determined by BET method is preferabley 20 to 500 $m^2/g$. When an average particle size exceeds 2 μm or when a specific surface area is less than 20 $m^2/g$, the surface of the photoconductor drum may tend to be damaged. When an average particle size is less than 0.003 μm or when a specific surface area exceeds 500 $m^2/g$, it is difficult to handle because it floats like dust.

It is necessary to add hydrophobic silica in such an amount so that the electric charge and fluidity of the toner are not decreased even under high temperature and high humidity conditions and that black spots do not occur. The addition amount is normally 0.01 to 1.5 parts by weight to 100 parts by weight of the toner, preferably 0.1 to 1.0 parts by weight.

Specifically, there is no generally definite amount of hydrophobic silica to be added because the adequate addition amount depends on the particle size of the toner. In general, when a toner particle size is about 10 to 15 μm, it may be added in as small quantity as 0.01 parts by weight. The addition amount is normally 0.01 to 1.0 parts by weight, preferably 0.1 to 0.5 parts by weight. In this case, if the addition amount is less than 0.01 parts by weight, the effective results can not be obtained. If it exceeds 1.0 parts by weight, it is not preferred because black spots may occur.

In the case that the small particle toner whose average size is 6 to 10 μm, the addition amount of hydrophobic silica is normally 0.1 to 1.5 parts by weight, preferably 0.2 to 1.0 parts by weight. In this case, if the addition amount is less than 0.1 parts by weight, sufficient fluidity can not be attained. If it exceeds 1.5 parts by weight, it is not preferred because black spots may occur as described above.

As the colorants to be used for a toner composition of the present invention, carbon black, iron black and the like as conventionally known can be used.

To a toner composition of the present invention, a charge control agent is added if necessary. To the negative charge toner, one or more types selected from all negative charge control agents, which are known to be used for an electrophotography in the past, may be used. Examples of the negative charge control agents include metal-containing azo dyes such as "Varifast Black 3804", "Bontron S-31", "Bontron S-32", "Bontron S-34" and "Bontron S-36" (all these products are manufactured by Orient Chemical Co., Ltd.) and "Aizen Spilon Black TVH" (manufactured by Hodogaya Chemical Co., Ltd.); copper phthalocyanine dyes; metal complexes of alkyl derivatives of salicyclic acid such as "Bontron E-85" (manufactured by Orient Chemical Co., Ltd.), quaternary ammonium salts such as "COPY CHARGE NX VP 434" (manufactured by Farbwerke Hoechst AG) and the like.

It is also possible to simultaneously use the main charge control agent together with the contrary polar charge control agent. When the contrary charge control agent is used in an amount of one-half or below of the amount of the main charge control agent, good visible images can be obtained with no reduction in image density even after 50,000 copies.

To the positive charge toner, one or more types selected from all positive charge control agents, which are known to be used for an electrophotography in the past, may be used. Examples of the positive charge control agent include nigrosine dyes such as "Nigrosine Base EX", "Oil Black BS", "Oil Black SO", "Bontron N-01" and "Bontron N-11" (all these products are manufactured by Orient Chemical Co., Ltd.); triphenylmethane dyes having a tertiary amine as a side chain such as "COPY BLUE PR" (manufactured by Farbwerke Hoechst AG); quaternary ammonium salt compounds such as "Bontron P-51" (manufactured by Orient Chemical Co., Ltd.), "COPY CHARGE PX VP 435" (manufactured by Farbwerke Hoechst AG) and cetyltrimethylammonium bromide; polyamine resin such as "AFP-B" (manufactured by Orient Chemical Co., Ltd.) and the like.

The above charge control agent may be contained in the composition in an amount of 0.1 to 8.0% by weight, preferably 0.2 to 5.0% by weight, based on the binder resin.

For the purpose of controlling the electric resistance and charge amount of toner or improving the clean ability of toner, fine powder of electroconductive metal oxides such as magnetite, tin oxide, zinc oxide, and titanium oxide having an average particle size of about 0.01 to 1 μm, fine particles of methylmethacrylate, polystyrene or methylmethacrylate methyl polymer, and fine particles of fluorine resins, such as polytetrafluoroethylene and polyvinylidene fluoride, may also be added in addition to hydrophobic silica fine powder according to the present invention. These fine powders are added in an amount of 0.01 to 5% by weight, preferably 0.05 to 1.0% by weight to the untreated toner weight.

To use a toner of the present invention as a magnetic toner, a magnetic powder may be added. As a magnetic powder for such purpose, a substance magnetized in a magnetic field is used. Examples of such substances include the powder of ferromagnetic metals such as iron, cobalt and nickel, alloys or compounds such as magnetite, hematite and ferrite. The preferable content of such magnetic powder is 15 to 70% by weight to the toner weight.

Further, a toner according to the present invention is used as a developer for an electric latent image, if necessary, by mixing it with carrier particles such as iron powder, glass beads, nickel powder and ferrite powder.

A toner composition of the present invention can be applied to various developing methods. Examples of the methods include the magnetic brush development, cascade development, development using a conductive magnetic toner, development using an insulative magnetic toner, fur brush development, powder cloud development, impression development and the like.

A toner composition of the present invention thus obtained contains hydrophobic silica having a degree of hydrophobic property of not less than 80. Accordingly, electric charge and fluidity of toner particles are not decreased under high temperature and high humidity conditions even though a polyester resin has a little more hydrophilic property than stylene acrylate resin and is used as a major component of the binder resin. Because it is added in a very slight quantity, the occurrence of black spots can be prevented.

Because the polyester resin for the present invention has good pulverizability, high resolution and high image quality can be obtained by easily reducing the average particle size of toner to about 6 to 10 μm; in this case, fluidity and environmental resistance which cannot be achieved by conventional methods can be ensured by adding the hydrophobic silica according to the present invention.

Also, because a pH value of hydrophobic silica used in the present invention is 5.5 to 8, rusting does not occur on the inner wall of the tank for manufacturing hydrophobic silica in the toner facilities even in long-term use.

In addition, even when a toner using such silica for a surface treatment is mixed with carriers such as iron powder or ferrite and it is preserved as a developer for a long time, rusting does not occur easily on the surface of the carrier.

As is evident from these descriptions, when the hydrophobic silica according to the present invention is used in the toner obtained using the polyester resin in one of the first to third modes of the present invention, higher fluidity and greater amount of charge can be ensured with smaller amounts of addition than those of the conventional hydrophobic silica with a lower degree of hydrophobic property, and it is possible to keep the amount of charge more stable even in use under high temperature and high humidity conditions. Particularly for toners having an average particle size of less than 10 μm, it has been necessary to increase the amount of hydrophobic silica added to ensure fluidity. However, because hydrophobic silica with a degree of hydrophobic property of not less than 80, such as H-2000, permits reduction in the amount of addition in comparison with that of conventional hydrophobic silica, it is possible to raise the margin against the occurrence of black spots. These effects have been accomplished by the toner composition of the present invention for the first time.

PREFERRED EMBODIMENTS

EXAMPLES

The present invention is hereinafter described in more detail by means of the following examples and comparative examples, but the invention is not limited to these examples.

In the Examples, all parts are expressed by weight.

Preparative Example 1

460 g of polyoxypropylene (2.2)-2,2-bis-(4-hydroxyphenyl) propane, 72 g of ethylene glycol, 306 g of terephthalic acid, 90 g of 1,2,4-benzenetricarboxylic acid anhydride (trimellitic acid anhydride), and 1.2 g of dibutylin oxide were placed in a 2-l four-necked glass flask equipped with a thermometer, a stainless steel stirring rod, a reflux condenser and a nitrogen-inlet tube and heated up to 190° C. for 5 hours, and followed at 220° C. in a mantle heater in a nitrogen atmosphere under stirring to carry out the reaction. The degree of polymerization was monitored from a softening point according to ASTM E 28-51 T and the reaction was terminated when the softening point had reached 130° C.

The resin thus obtained was a solid substance in light yellow color and a glass transition temperature determined by the differential scanning calorimeter (DSC) was 64° C. Hereinafter, the resin is referred as "binder resin (A)".

Preparative Examples 2 to 3

The same procedure as that described in Preparative Example 1 was repeated using the starting materials as shown in Table 1 to obtain "binder resin (B)" and "binder resin (C)".

TABLE 1

| Monomer content (mol %) | Binder resin (A) | (B) | (C) |
|---|---|---|---|
| Polyoxypropylene(2.2)-2,2-bis-(4-hydroxyphenyl)propane | 27 | 27 | 22 |
| Polyoxyethylene(2)-2,2-bis-(4-hydroxyphenyl)propane | — | — | 5 |
| Ethylene glycol | 24 | 20 | 20 |
| 1,2-Propylene glycol | — | — | 4 |
| Diethylene glycol | — | 4 | — |
| Terephthalic acid | 39 | 39 | 39 |
| Trimellitic acid anhydride | 10 | 10 | 10 |
| Physical properties | | | |
| Softening point (°C.) | 130 | 130 | 130 |
| Glass transition temperature (°C.) | 64 | 62 | 64 |

Preparative Example 4

164.9 g of polyoxypropylene (2.2)-2,2-bis-(4-hydroxyphenyl)propane, 86.5 g of ethylene glycol, 84.4 g of 1,2-propylene glycol, 430.7 g of dimethyl terephthalate, 106.6 g of 1,2,4-benzenetricarboxylic acid anhydride (trimellitic acid anhydride), and 1.2 g of dibutyltin oxide were placed in a 2-l four-necked glass flask equipped with a thermometer, a stainless steel stirring rod, a reflux condenser and a nitrogen-inlet tube and heated up to 170° C. for 5 hours, and followed at 220° C. in a mantle heater in a nitrogen atmosphere under stirring to carry out the reaction. The degree of polymerization was monitored from a softening point according to ASTM E 28-51 T and the reaction was terminated when the softening point had reached 130° C.

The resin thus obtained was a solid substance in light yellow color and a glass transition temperature determined by DSC was 63° C. Hereinafter, the resin is referred as "binder resin (D)".

Preparative Examples 5 to 6

The same procedure as that described in Preparative Example 4 was repeated using the starting materials as shown in Table 2 to obtain "binder resin (E)" and "binder resin (F)".

TABLE 2

| Monomer content (mol %) | Binder resin (D) | (E) | (F) |
|---|---|---|---|
| Polyoxypropylene (2.2)-2,2-bis-(4-hydroxyphenyl)propane | 8 | — | — |
| Ethylene glycol | 24 | — | 20 |
| 1,3-Propylene glycol | — | 23 | — |
| 1,4-Butanediol | — | — | 3 |
| 1,2-Propylene glycol | 19 | 28 | 26 |
| Diethylene glycol | — | — | 2 |
| Terephthalic acid | 39 | 39 | 39 |
| Trimellitic acid anhydride | 10 | 10 | 10 |
| Physical properties | | | |
| Softening point (°C.) | 130 | 130 | 130 |
| Glass transition temperature (°C.) | 63 | 60 | 61 |

Preparative Example 7

89.3 g of ethylene glycol, 75.5 g of 1,2-propylene glycol, 62.4 g of neopentyl glycol, 368.5 g of terephthalic acid and 1.5 g of dibutyltin dilaurate were placed in a 2-l four-necked glass flask equipped with a thermometer, a stainless steel stirring rod, a reflux condenser and a nitrogen-inlet tube and heated up to 170° C. for 5 hours, and followed at 210° C. in a mantle heater in a nitrogen atmosphere under stirring to carry out the reaction. The degree of polymerization was monitored from a softening point according to ASTM E 28-51 T. When the softening point came to be unchangeable, at this stage, an acid value of the resin being 0.5 KOH mg/g, a hydroxyl value being 143.3 KOH mg/g, and the number-average molecular weight calculated from these values being 780, 138.2 g of trimellitic acid anhydride was further added and the reaction was continued at 210° C. until the softening point reached the predetermined temperature and the resulting resin was cooled to room tempearture.

The resin thus obtained was a solid substance in light yellow color and a glass transition temperature determined by DSC was 64° C. Hereinafter, the resin is referred as "binder resin (G)".

Preparative Examples 8 to 9

The same procedure as that described in Preparative Example 7 was repeated using the monomer components as shown in Table 3 to obtain "binder resin (H)" and "binder resin (I).

TABLE 3

| Monomer content (mol %) | Binder resin (G) | (H) | (I) |
|---|---|---|---|
| Ethylene glycol | 24 | 24 | 20 |
| 1,2-Propylene glycol | 18 | 18 | 8 |
| Diethylene glycol | — | — | 4 |
| Neopentyl glycol | 9 | 9 | 19 |
| Terephthalic acid | 37 | 32 | 44 |
| Dodecenylsuccinic acid anhydride | — | 5 | — |
| Trimellitic acid anhydride | 12 | 12 | 5 |
| Physical properties | | | |
| Softening point (°C.) | 130 | 130 | 130 |
| Glass transition temperature (°C.) | 64 | 62 | 62 |
| A number-average molecular weight of the polyester previously polymerized without the monomers having three or more functional groups | 780 | 510 | 1240 |

Preparation of toner

After the materials having the composition as shown below were mixed well by Henschel mixer, the mixture was kneaded by a twin screw compounder and was cooled and coarsely crushed. Then, it was pulverized by a jet mill and was further classified by a pneumatic classifier to obtain fine powder having an average particle size as below.

Untreated toner (1):

| | |
|---|---|
| binder resin (A) | 88 parts |
| carbon black "Regal 400R" (manufactured by Cabot Corporation) | 8 parts |
| negative charge control agent "Aizen Spilon Black T-77" (manufactured by Hodogaya Chemical Co., Ltd.) | 2 parts |
| wax "Viscol TS-200" (manufactured by Sanyo Chemical Industries, Ltd.) | 2 parts |
| average particle size | 10, 9, 7 or 6 μm |

Untreated toner (2):

| | |
|---|---|
| binder resin (B) | 90 parts |
| carbon black "Carbon black #44" manufactured by Mitsubishi Kasei Corporation) | 5 parts |
| negative charge control agent "Bontron S-34" (manufactured by Orient Chemical Co., Ltd.) | 2 parts |
| positive charge control agent "Bontron N-01" (manufactured by Orient Chemical Co., Ltd.) | 0.9 parts |
| wax "Viscol 550P" (manufactured by Sanyo Chemical Industries, Ltd.) | 2 parts |
| average particle size | 8 μm |

Untreated toner (3):

| | |
|---|---|
| binder resin (C) | 88 parts |
| carbon black "Regal 400R" (manufactured by Cabot Corporation) | 8 parts |
| negative charge control agent "Aizen Spilon Black T-77" (manufactured by Hodogaya Chemical Co., Ltd.) | 2 parts |
| wax "Viscol TS-200" (manufactured by Sanyo Chemical Industries, Ltd.) | 2 parts |
| average particle size | 6 μm |

Untreated toner (4):

| | |
|---|---|
| binder resin (D) | 89 parts |
| carbon black "Regal 400R" (manufactured by Cabot Corporation) | 6 parts |
| negative charge control agent "CCA-7" (manufactured by ICI Japan) | 2 parts |
| positive charge control agent "Bontron N-11" (manufactured by Orient Chemical Co., Ltd.) | 0.9 parts |
| wax "Viscol 550P" (manufactured by Sanyo Chemical Industries, Ltd.) | 2 parts |
| average particle size | 10 or 7 μm |

Untreated toner (5):

The same composition as the Untreated toner (4) except that the binder resin is the binder resin (E).

average particle size 7 μm

-continued

Untreated toner (6):

| | |
|---|---|
| binder resin (F) | 88 parts |
| carbon black "Carbon black #44" manufactured by Mitsubishi Kasei Corporation) | 8 parts |
| negative charge control agent "Aizen Spilon Black T-77" (manufactured by Hodogaya Chemical Co., Ltd.) | 2 parts |
| wax "Viscol TS-200" (manufactured by Sanyo Chemical Industries, Ltd.) | 2 parts |
| average particle size | 10 or 6 μm |

Untreated toner (7):

| | |
|---|---|
| binder resin (D) | 90 parts |
| carbon black "Carbon black #44" manufactured by Mitsubishi Kasei Corporation) | 6 parts |
| positive charge control agent "Bontron N-01" (manufactured by Orient Chemical Co., Ltd.) | 2 parts |
| wax "Viscol TS-200" (manufactured by Sanyo Chemical Industries, Ltd.) | 2 parts |
| average particle size | 10 or 7 μm |

Untreated toner (8):

The same composition as the Untreated toner (7) except that the binder resin is the binder resin (E).

average particle size 7 μm

Untreated toner (9):

The same composition as the Untreated toner (7) except that the binder resin is the binder resin (F).

average particle size 10, 7 or 6 μm

Untreated toner (10):

| | |
|---|---|
| binder resin (G) | 88 parts |
| carbon black "Regal 400R" (manufactured by Cabot Corporation) | 6 parts |
| negative charge control agent "CCA-7" (manufactured by ICI Japan) | 2 parts |
| positive charge control agent "Bontron N-11" (manufactured by Orient Chemical Co., Ltd.) | 0.9 parts |
| wax "Viscol 550-P" (manufactured by Sanyo Chemical Industries, Ltd.) | 2 parts |
| average particle size | 10 or 7 μm |

Untreated toner (11):

The same composition as the Untreated toner (10) except that the binder resin is the binder resin (H).

average particle size 7 μm

Untreated toner (12):

| | |
|---|---|
| binder resin (I) | 88 parts |
| carbon black "Carbon black #44" manufactured by Mitsubishi Kasei Corporation) | 8 parts |
| negative charge control agent "Aizen Spilon Black T-77" (manufactured by Hodogaya Chemical Co., Ltd.) | 2 parts |
| wax "Viscol TS-200" (manufactured by Sanyo Chemical Industries, Ltd.) | 2 parts |
| average particle size | 10 or 6 μm |

Untreated toner (13):

| | |
|---|---|
| binder resin (G) | 90 parts |
| carbon black "Carbon black #44" (manufactured by Mitsubishi Kasei Corporation) | 5 parts |
| positive charge control agent "Bontron N-01" (manufactured by Orient Chemical Co., Ltd.) | 2 parts |
| wax "Viscol TS-200" (manufactured by Sanyo Chemical Industries, Ltd.) | 2 parts |
| average particle size | 10 or 7 μm |

Untreated toner (14):

The same composition as the Untreated toner (13) except that the binder resin is the binder resin (H).

average particle size 7 μm

Untreated toner (15):

The same composition as the Untreated toner (13) except that the binder resin is the binder resin (I).

average particle size 10, 7 or 6 μm

EXAMPLE 1

To 1,000 g of the above untreated toner (1) (average particle size: 10 μm), 1.5 g of hydrophobic silica "HDK H-2000" (manufactured by Wacker Chemicals East Asia Limited) was added. The toner 1 was obtained by mixing it by a Henschel mixer.

EXAMPLE 2

To 1,000 g of the above untreated toner (1) (average particle size: 10 μm), 2.5 g of hydrophobic silica "HDK H-2000" was added. The toner 2 was obtained by mixing it by a Henschel mixer.

EXAMPLE 3

To 1,000 g of the above untreated toner (1) (average particle size: 9 μm), 3.5 g of hydrophobic silica "HDK H-2000" was added. The toner 3 was obtained by mixing it by a Henschel mixer.

EXAMPLE 4

To 1,000 g of the above untreated toner (2) (average particle size: 8 μm), 2.5 g of hydrophobic silica "CAB-O-SIL TS-720" (manufactured by Cabot Corporation) was added. The toner 4 was obtained by mixing it by a Henschel mixer.

EXAMPLE 5

To 1,000 g of the above untreated toner (2) (average particle size: 8 μm), 3.5 g of hydrophobic silica "CAB-O-SIL TS-720" was added. The toner 5 was obtained by mixing it by a Henschel mixer.

EXAMPLE 6

To 1,000 g of the above untreated toner (3) (average particle size: 6 μm), 2.5 g of hydrophobic silica "CAB-O-SIL TS-530" (manufactured by Cabot Corporation) was added. The toner 6 was obtained by mixing it by a Henschel mixer.

Example 7

To 1,000 g of the above untreated toner (3) (average particle size: 6 μm), 3.5 g of hydrophobic silica "CAB-O-SIL TS-530" was added. The toner 7 was obtained by mixing it by a Henschel mixer.

Example 8

To 1,000 g of the above untreated toner (4) (average particle size: 10 μm), 1.5 g of hydrophobic silica "HDK H-2000" was added. The toner 8 was obtained by mixing it by a Henschel mixer.

Example 9

To 1,000 g of the above untreated toner (4) (average particle size: 7 μm), 2.5 g of hydrophobic silica "HDK H-2000" was added. The toner 9 was obtained by mixing it by a Henschel mixer.

Example 10

To 1,000 g of the above untreated toner (5) (average particle size: 7 μm), 3.5 g of hydrophobic silica "CAB-O-SIL TS-720" was added. The toner 10 was obtained by mixing it by a Henschel mixer.

Example 11

To 1,000 g of the above untreated toner (6) (average particle size: 10 μm), 1.5 g of hydrophobic silica "CAB-O-SIL TS-530" was added. The toner 11 was obtained by mixing it by a Henschel mixer.

Example 12

To 1,000 g of the above untreated toner (6) (average particle size: 6 μm), 3.5 g of hydrophobic silica "CAB-O-SIL TS-530" was added. The toner 12 was obtained by mixing it by a Henschel mixer.

Example 13

To 1,000 g of the above untreated toner (7) (average particle size: 10 μm), 1.5 g of hydrophobic silica "HDK H-2000" was added. The toner 13 was obtained by mixing it by a Henschel mixer.

Example 14

To 1,000 g of the above untreated toner (7) (average particle size: 7 μm), 3.5 g of hydrophobic silica "HDK H-2000" was added. The toner 14 was obtained by mixing it by a Henschel mixer.

Example 15

To 1,000 g of the above untreated toner (8) (average particle size: 7 μm), 3.5 g of hydrophobic silica "CAB-O-SIL TS-720" was added. The toner 15 was obtained by mixing it by a Henschel mixer.

Example 16

To 1,000 g of the above untreated toner (9) (average particle size: 10 μm), 1.5 g of hydrophobic silica "CAB-O-SIL TS-530" was added. The toner 16 was obtained by mixing it by a Henschel mixer.

Example 17

To 1,000 g of the above untreated toner (9) (average particle size: 6 μm), 3.5 g of hydrophobic silica "CAB-O-SIL TS-530" was added. The toner 17 was obtained by mixing it by a Henschel mixer.

Example 18

To 1,000 g of the above untreated toner (10) (average particle size: 10 μm), 1.5 g of hydrophobic silica "HDK H-2000" was added. The toner 18 was obtained by mixing it by a Henschel mixer.

Example 19

To 1,000 g of the above untreated toner (10) (average particle size: 7 μm), 2.5 g of hydrophobic silica "HDK H-2000" was added. The toner 19 was obtained by mixing it by a Henschel mixer.

Example 20

To 1,000 g of the above untreated toner (11) (average particle size: 7 μm), 3.5 g of hydrophobic silica "CAB-O-SIL TS-720" was added. The toner 20 was obtained by mixing it by a Henschel mixer.

Example 21

To 1,000 g of the above untreated toner (12) (average particle size: 10 μm), 1.5 g of hydrophobic silica "CAB-O-SIL TS-530" was added. The toner 21 was obtained by mixing it by a Henschel mixer.

Example 22

To 1,000 g of the above untreated toner (12) (average particle size: 6 μm), 3.5 g of hydrophobic silica "CAB-O-SIL TS-530" was added. The toner 22 was obtained by mixing it by a Henschel mixer.

EXAMPLE 23

To 1,000 g of the above untreated toner (13) (average particle size: 10 μm), 1.5 g of hydrophobic silica "HDK H-2000" was added. The toner 23 was obtained by mixing it by a Henschel mixer.

EXAMPLE 24

To 1,000 g of the above untreated toner (13) (average particle size: 7 μm), 3.5 g of hydrophobic silica "HDK H-2000" was added. The toner 24 was obtained by mixing it by a Henschel mixer.

EXAMPLE 25

To 1,000 g of the above untreated toner (14) (average particle size: 7 μm), 3.5 g of hydrophobic silica "CAB-O-SIL TS-720" was added. The toner 25 was obtained by mixing it by a Henschel mixer.

EXAMPLE 26

To 1,000 g of the above untreated toner (15) (average particle size: 10 μm), 1.5 g of hydrophobic silica "CAB-O-SIL TS-530" was added. The toner 26 was obtained by mixing it by a Henschel mixer.

EXAMPLE 27

To 1,000 g of the above untreated toner (15) (average particle size: 6 μm), 3.5 g of hydrophobic silica "CAB-O-SIL TS-530" was added. The toner 27 was obtained by mixing it by a Henschel mixer.

Comparative example 1

To 1,000 g of the above untreated toner (1) (average particle size: 10 μm), 2.5 g of hydrophobic silica "AEROSIL R-972" (manufactured by Nippon Aerosil Co., Ltd.) was added. The comparative toner 1 was obtained by mixing it by a Henschel mixer.

Comparative example 2

To 1,000 g of the above untreated toner (1) (average particle size: 7 μm), 5.0 g of hydrophobic silica "AEROSIL R-972" was added. The comparative toner 2 was obtained by mixing it by a Henschel mixer.

Comparative example 3

To 1,000 g of the above untreated toner (1) (average particle size: 6 μm), 5.0 g of hydrophobic silica "HDK H-15" (manufactured by Wacker Chemicals East Asia Limited, degree of hydrophobic property 40; pH 4.0) was added. The comparative toner 3 was obtained by mixing it by a Henschel mixer.

Comparative example 4

To 1,000 g of the above untreated toner (4) (average particle size: 7 μm), 2.5 g of hydrophobic silica "AEROSIL R-972" was added. The comparative toner 4 was obtained by mixing it by a Henschel mixer.

Comparative example 5

To 1,000 g of the above untreated toner (4) (average particle size: 7 μm), 5.0 g of hydrophobic silica "AEROSIL R-972" was added. The comparative toner 5 was obtained by mixing it by a Henschel mixer.

Comparative example 6

To 1,000 g of the above untreated toner (9) (average particle size: 7 μm), 2.5 g of hydrophobic silica "CAB-O-SIL TS-610" (manufactured by Cabot Corporation) was added. The comparative toner 6 was obtained by mixing it by a Henschel mixer.

Comparative example 7

To 1,000 g of the above untreated toner (9) (average particle size: 7 μm), 5.0 g of hydrophobic silica "CAB-O-SIL TS-610" was added. The comparative toner 7 was obtained by mixing it by a Henschel mixer.

Comparative example 8

To 1,000 g of the above untreated toner (10) (average particle size: 7 μm), 2.5 g of hydrophobic silica "AEROSIL R-972" was added. The comparative toner 8 was obtained by mixing it by a Henschel mixer.

Comparative example 9

To 1,000 g of the above untreated toner (10) (average particle size: 7 μm), 5.0 g of hydrophobic silica "AEROSIL R-972" was added. The comparative toner 9 was obtained by mixing it by a Henschel mixer.

Comparative example 10

To 1,000 g of the above untreated toner (15) (average particle size: 7 μm), 2.5 g of hydrophobic silica "HDK H-15" was added. The comparative toner 10 was obtained by mixing it by a Henschel mixer.

Comparative example 11

To 1,000 g of the above untreated toner (15) (average particle size: 7 μm), 5.0 g of hydrophobic silica "HDK H-15" was added. The comparative toner 11 was obtained by mixing it by a Henschel mixer.

Using the above toners, the fluidity and the electric charge-to-mass ratio as well as the occurrence of black spots were evaluated.

The average particle size of toner was determined by the electric resistance method using a Coulter counter.

Specifically, the measuring apparatus used was the Coulter counter model TA-II (manufactured by Coulter Electronics, Inc.), which was connected with an interface for output of number distribution and volume distribution (manufactured by Japan Scientific Instrument Co., Ltd.) and a PC-9801 personal computer (manufactured by NEC Corporation). For the electrolytic solution, a 1% aqueous solution of sodium chloride was prepared with JIS Grade 1 sodium chloride. To 100 to 150 ml of the aqueous electrolytic solution, 0.1 to 5 ml of a surfactant, preferably alkylbenzenesulfonate was added as a dispersing agent, and a 2 to 20 mg sample was added. The sample suspension in the electrolytic solution was subjected to a dispersing treatment using an ultrasonic dispersing machine for about 1 to 3 minutes. Then, using the Coulter counter model TA-II and a 100μ aperture, the particle size distribution of the particles having a diameter of 2 to 40μ was determined, and the diameter corresponding to 50% of the weight distribution was taken as the average particle size.

The fluidity of the toner was determined by a toner fluid tester as described below. Specifically, it is a fluidity evaluation apparatus equipped with a screw rotating at a speed of 10 rpm in a conical hopper and a buffer unit. For the measurement, 300 g of the toner to be measured is placed in a 1-l polyvinyl container. After shaking it strongly up and down by hand for 10 times, the content is transferred to a hopper. By rotating a motor for 5 minutes, the fallen amount of the toner per minute is determined from the weight of the toner fallen onto the receptacle, and this is regarded as the fallen amount of the toner [g/min].

The charge-to-mass ratio was measured by a blow-off tribo electric charge measuring apparatus as described below. Specifically, it is a charge-to-mass ratio measuring apparatus equipped with a Faraday gauge, a capacitor and an electrometer. For the measurement, the toner sample to be measured is mixed well with a spherical ferrite carrier having a particle size of 250 to 400 mesh by the weight ratio of 10:90, followed by stirring and the developer is thus prepared.

W (g) (0.15 to 0.20 g) of the developer thus prepared is placed into a brass measurement cell equipped with a stainless steel screen of 500 mesh (adjustable to any mesh size to block the passing of carrier particles). Then, after sucking this for 5 seconds from the suction hole, it is blown off for 5 seconds at an air pressure of 0.6 kg/m$^2$ as indicated by an air pressure regulator and only the toner is removed from the cell. It is supposed that the voltage on the electrometer at 2 seconds after starting the blowing is V (volt). If it is supposed that an electric capacity of the capacitor is C (μF), a charge-to-mass ratio Q/m of this toner is given by the following equation:

$$Q/m\ (\mu c/g) = \frac{C \times V}{m}$$

Here, m representrs a weight of the toner contained in W (g) of a developer. In the case that a toner weight in a developer is supposed to be T (g), and a weight of a developer is D (g), a concentration of a specimen toner is expressed by: T/D×100 (%), and m is obtained from the following equation.

$$m(g) = W \times \frac{T/D}{100}$$

As a developing agent for negatively chargeable toner, a mixture of 10 parts by weight of the toner and 90 parts by weight of a spherical ferrite carrier having a particle size of 250 to 400 mesh was used in a copying machine equipped with a selenium photoreceptor. As a developing agent for positively chargeable toner, a mixture of 10 parts by weight of the toner and 90 parts by weight of a resin-coated amorphous iron powder carrier having a particle size of 250 to 400 mesh was used in a copying machine equipped with an organic photoreceptor. For each case, 50000 copies were taken successively under ordinary conditions (23° C., 50% RH) and under high temperature and high humidity conditions (35° C., 85% RH), and comparisons were made with respect to the changes in the charge-to-mass ratio and the occurrence of black spots during the printing durability test.

The results are shown in Tables 4 through 8. In comparison with toners 1 through 27 according to the present invention, comparative toners 1 through 11 showed greater reduction in the charge-to-mass ratio after 50000 copies were taken under high temperature and high humidity conditions, and in any case, images were difficult to evaluate because of the occurrence of black spots or severe background stain under high temperature and high humidity conditions.

TABLE 4

| Toner | Hydrophobic silica kind | Hydrophobic silica addition amount | Characteristics of toner: Average particle size [μm] | Characteristics of toner: Fluidity [g/min] | Characteristics of toner: Electric Charge [μc/g] | Change of electric charge after 50,000 copies [μc/g]: normal condition 23° C., 50% RH | Change of electric charge after 50,000 copies [μc/g]: high temp. and high humidity condition 35° C., 85% RH | Number of copies duplicated until black spots occur: normal condition | Number of copies duplicated until black spots occur: high temp. and high humidity condition |
|---|---|---|---|---|---|---|---|---|---|
| Toner 1 | H-2000 | 0.15% | 10 | 7.0 | −18.8 | +1 | −2 | no occurrence | no occurrence |
| 2 | H-2000 | 0.25% | 10 | 7.7 | −19.5 | +1 | 0 | no occurrence | no occurrence |
| 3 | H-2000 | 0.35% | 9 | 7.9 | −24.6 | +3 | +1 | no occurrence | no occurrence |
| 4 | TS-720 | 0.25% | 8 | 6.9 | −23.6 | +1 | +1 | no occurrence | no occurrence |
| 5 | TS-720 | 0.35% | 8 | 7.4 | −25.7 | +2 | +3 | no occurrence | no occurrence |
| 6 | TS-530 | 0.25% | 6 | 6.7 | −28.2 | 0 | +1 | no occurrence | no occurrence |
| 7 | TS-530 | 0.35% | 6 | 7.4 | −30.4 | +1 | +2 | no occurrence | no occurrence |
| Comparative toner 1 | R-972 | 0.25% | 10 | 6.4 | −17.2 | +3 | −9 | no occurrence | occurred at 40,000 copies |
| 2 | R-972 | 0.50% | 7 | 7.3 | −27.0 | +6 | −5 | occurred at 15,000 copies | occurred at 10,000 copies |
| 3 | H-15 | 0.50% | 6 | 7.0 | −28.9 | +3 | −10 | occurred at 20,000 copies | occurred at 15,000 copies |

TABLE 5

| Toner | Hydrophobic silica kind | Hydrophobic silica addition amount | Characteristics of toner: Average particle size [μm] | Characteristics of toner: Fluidity [g/min] | Characteristics of toner: Electric Charge [μc/g] | Change of electric charge after 50,000 copies [μc/g]: normal condition 23° C., 50% RH | Change of electric charge after 50,000 copies [μc/g]: high temp. and high humidity condition 35° C., 85% RH | Number of copies duplicated until black spots occur: normal condition | Number of copies duplicated until black spots occur: high temp. and high humidity condition |
|---|---|---|---|---|---|---|---|---|---|
| Toner 8 | H-2000 | 0.15% | 10 | 7.0 | −16.9 | 0 | −3 | no occurrence | no occurrrence |
| 9 | H-2000 | 0.25% | 7 | 7.1 | −24.8 | +2 | −2 | no occurrence | no occurrence |
| 10 | TS-720 | 0.35% | 7 | 7.4 | −26.6 | −1 | −2 | no occurrence | no occurrence |
| 11 | TS-530 | 0.15% | 10 | 7.2 | −16.2 | +1 | 0 | no occurrence | no occurrence |
| 12 | TS-530 | 0.35% | 6 | 7.3 | −29.0 | +2 | +1 | no occurrence | no occurrence |
| 13 | H-2000 | 0.15% | 10 | 7.1 | +14.2 | −1 | −3 | no occurrence | no occurrence |
| 14 | H-2000 | 0.35% | 7 | 7.1 | +20.6 | −2 | −1 | no occurrence | no occurrence |
| 15 | TS-720 | 0.35% | 7 | 7.1 | +20.1 | −3 | −2 | no occurrence | no occurrence |
| 16 | TS-530 | 0.15% | 10 | 7.4 | +15.8 | 0 | −2 | no occurrence | no occurrence |

TABLE 5-continued

| Toner | Hydrophobic silica kind | Hydrophobic silica addition amount | Characteristics of toner: Average particle size [μm] | Characteristics of toner: Fluidity [g/min] | Characteristics of toner: Electric Charge [μc/g] | Change of electric charge after 50,000 copies [μc/g]: normal condition 23° C., 50% RH | Change of electric charge after 50,000 copies [μc/g]: high temp. and high humidity condition 35° C., 85% RH | Number of copies duplicated until black spots occur: normal condition | Number of copies duplicated until black spots occur: high temp. and high humidity condition |
|---|---|---|---|---|---|---|---|---|---|
| 17 | TS-530 | 0.35% | 6 | 7.3 | +23.2 | +1 | −1 | no occurrence | no occurrence |

TABLE 6

| Toner | Hydrophobic silica kind | Hydrophobic silica addition amount | Characteristics of toner: Average particle size [μm] | Characteristics of toner: Fluidity [g/min] | Characteristics of toner: Electric Charge [μc/g] | Change of electric charge after 50,000 copies [μc/g]: normal condition 23° C., 50% RH | Change of electric charge after 50,000 copies [μc/g]: high temp. and high humidity condition 35° C., 85% RH | Number of copies duplicated until black spots occur: normal condition | Number of copies duplicated until black spots occur: high temp. and high humidity condition |
|---|---|---|---|---|---|---|---|---|---|
| Comparative toner 4 | R-972 | 0.25% | 7 | 5.1 | −25.7 | +2 | −8 | no occurrence | occurred at 30,000 copies |
| 5 | R-972 | 0.50% | 7 | 6.5 | −28.3 | +9 | −4 | occurred at 15,000 copies | occurred at 10,000 copies |
| 6 | TS-610 | 0.25% | 7 | 5.2 | +17.9 | −4 | −9 | no occurrence | severe background stain from 10,000 copies, difficult to evaluate |
| 7 | TS-610 | 0.50% | 7 | 6.7 | +17.2 | −3 | −10 | occurred at 10,000 copies | occurred at 10,000 copies |

TABLE 7

| Toner | Hydrophobic silica kind | Hydrophobic silica addition amount | Characteristics of toner: Average particle size [μm] | Characteristics of toner: Fluidity [g/min] | Characteristics of toner: Electric Charge [μc/g] | Change of electric charge after 50,000 copies [μc/g]: normal condition 23° C., 50% RH | Change of electric charge after 50,000 copies [μc/g]: high temp. and high humidity condition 35° C., 85% RH | Number of copies duplicated until black spots occur: normal condition | Number of copies duplicated until black spots occur: high temp. and high humidity condition |
|---|---|---|---|---|---|---|---|---|---|
| Toner 18 | H-2000 | 0.15% | 10 | 7.0 | −15.8 | +1 | −2 | no occurrence | no occurrence |
| 19 | H-2000 | 0.25% | 7 | 7.2 | −23.4 | +2 | −1 | no occurrence | no occurrence |
| 20 | TS-720 | 0.35% | 7 | 7.5 | −25.6 | −1 | −3 | no occurrence | no occurrence |
| 21 | TS-530 | 0.15% | 10 | 7.3 | −16.1 | 0 | −1 | no occurrence | no occurrence |
| 22 | TS-530 | 0.35% | 6 | 8.1 | −28.7 | +2 | 0 | no occurrence | no occurrence |
| 23 | H-2000 | 0.15% | 10 | 7.0 | +13.9 | −2 | −2 | no occurrence | no occurrence |
| 24 | H-2000 | 0.35% | 7 | 7.1 | +18.2 | −1 | −1 | no occurrence | no occurrence |
| 25 | TS-720 | 0.35% | 7 | 7.3 | +17.9 | −2 | −1 | no occurrence | no occurrence |
| 26 | TS-530 | 0.15% | 10 | 7.4 | +14.7 | +1 | −2 | no occurrence | no occurrence |
| 27 | TS-530 | 0.35% | 6 | 7.1 | +22.1 | 0 | −1 | no occurrence | no occurrence |

TABLE 8

| Toner | Hydrophobic silica kind | Hydrophobic silica addition amount | Characteristics of toner: Average particle size [μm] | Characteristics of toner: Fluidity [g/min] | Characteristics of toner: Electric Charge [μc/g] | Change of electric charge after 50,000 copies [μc/g]: normal condition 23° C., 50% RH | Change of electric charge after 50,000 copies [μc/g]: high temp. and high humidity condition 35° C., 85% RH | Number of copies duplicated until black spots occur: normal condition | Number of copies duplicated until black spots occur: high temp. and high humidity condition |
|---|---|---|---|---|---|---|---|---|---|
| Comparative toner 8 | R-972 | 0.25% | 7 | 5.2 | −22.3 | +3 | −9 | no occurrence | occurred at 35,000 copies |
| 9 | R-972 | 0.50% | 7 | 6.3 | −24.7 | +8 | −5 | occurred at 10,000 copies | occurred at 10,000 copies |
| 10 | H-15 | 0.25% | 7 | 5.4 | +17.1 | −3 | −9 | no occurrence | severe background stain from 10,000 copies, difficult to evaluate |
| 11 | H-15 | 0.50% | 7 | 6.6 | +18.3 | −4 | −11 | occurred at 10,000 copies | occurred at 15,0000 copies |

degree of hydrophobic property and pH value:
H-2000 80; pH 7.0
R-972 40; pH 4.0
TS-720 80; pH 5.8
TS-530 110; pH 6.0
TS-610 40; pH 4.0
H-15 40; pH 4.0

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner composition comprising a binder resin containing a polyester resin as a major component of said binder resin, wherein said polyester resin is obtained by co-condensation polymerization of:

(i) a diol component represented by the general formula (1)

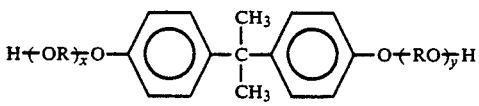

(1)

(wherein R represents an ethylene or propylene group, x and y are each an integer of 1 or more, and the average value of x+y is 2 to 7)

in an amount of not less than 10 mol % and not more than 30 mol % based on the entire monomer content;

(ii) a diol component represented by the general formula (2)

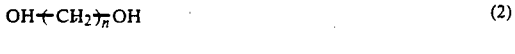

(2)

(wherein n is an integer of 2 to 6)

in an amount of not less than 10 mol % and less than 25 mol % based on the entire monomer content;

(iii) a dibasic carboxylic acid, an anhydride thereof or a lower alkyl ester thereof; and (iv) a tribasic or higher polybasic carboxylic acid, an anhydride thereof or a lower alkyl ester thereof in an amount of not less than 2.5 mol % and less than 15 mol % based on the entire monomer content, and 0.01 to 1.5 parts by weight of hydrophobic silica having a degree of hydrophobic property of not less than 80 as determined by a methanol titration test with 100 parts by weight of said toner.

2. A toner composition comprising a binder resin containing a polyester resin as a major component of said binder resin, wherein said polyester resin is obtained by co-condensation polymerization of:

(i) a diol component represented by the general formula (1)

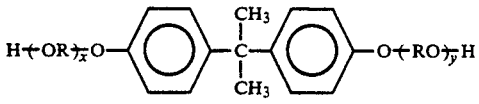

(1)

(wherein R represents an ethylene or propylene group, x and y are each an integer of 1 or more, and the average value of x+y is 2 to 7)

in an amount of less than 10 mol % based on the entire monomer content;

(ii) a diol component represented by the general formula (2)

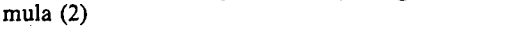

(2)

(wherein n is an integer of 2 to 6)

in an amount of not less than 10 mol % and less than 25 mol % based on the entire monomer content;

(iii) a dibasic carboxylic acid, an anhydride thereof, or a lower alkyl ester thereof; and (iv) a tribasic or higher polybasic carboxylic acid, an anhydride thereof, or a lower alkyl ester thereof in an amount of not less than 2.5 mol % and less than 15 mol % based on the entire monomer content; and 0.01 to 1.5 parts by weight of hydrophobic silica having a degree of hydrophobic property of not less than 80 as determined by a methanol titration test with 100 parts by weight of said toner.

3. A toner composition comprising a binder resin containing a polyester resin as a major component of said binder resin, wherein said polyester resin is obtained by co-condensation polymerization of:

(i) a diol component represented by the general formula (1)

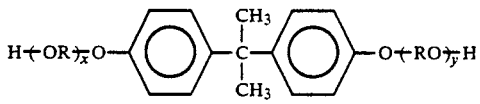

(1)

(wherein R represents an ethylene or propylene group, x and y are each an integer of 1 or more, and the average value of x+y is 2 to 7)

in an amount of less than 10 mol % based on the entire monomer content;

(ii) a diol component represented by the general formula (2)

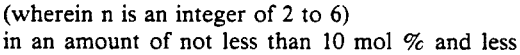

(2)

(wherein n is an integer of 2 to 6)

in an amount of not less than 10 mol % and less than 25 mol % based on the entire monomer content;

(iii) a dibasic carboxylic acid, an anhydride thereof, or a lower alkyl ester thereof;

(iv) a tribasic or higher polybasic carboxylic acid, an anhydride thereof, or a lower alkyl ester thereof in an amount of not less than 2.5 mol % and less than 15 mol % based on the entire monomer content; and (v) a diol component represented by the general formula (3)

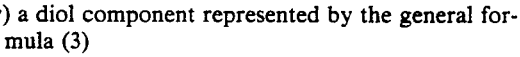

(3)

(wherein R' represents an alkylene group having a carbon number of 2 to 4 and n is an integer of 2 to 4)

in an amount of not less than 1.5 mol % and less than 10 mol % based on the entire monomer content, and 0.01 to 1.5 parts by weight of hydrophobic silica having a degree of hydrophobic property of not less than 80, said degree determined by a methanol titration test with 100 parts by weight of said toner.

4. A toner composition comprising a binder resin containing a polyester resin as a major component of said binder resin, wherein said polyester resin is obtained by co-condensation polymerization of:

a linear or branched polyester having a number-average molecular weight of 300 to 1400, a tribasic or higher polybasic carboxylic acid or a derivative thereof and/or a trihydric or higher polyhydric alcohol, wherein a diol component represented by the general formula (2):

$$OH\text{-}(CH_2)_n\text{-}OH \quad (2)$$

(wherein n is an integer of 2 to 6)

is used as a dihydric alcohol in an amount of not less than 10 mol % and less than 25 mol % based on the entire monomer content, and 0.01 to 1.5 parts by weight of hydrophobic silica having a degree of hydrophobic property of not less than 80, determined by a methanol titration test with 100 parts by weight of said toner.

5. A toner composition comprising a binder resin containing a polyester resin as a major composition of said binder resin, wherein said polyester resin is obtained by co-condensation polymerization of:

(i) a diol component represented by the general formula (1)

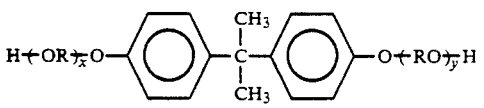

(1)

(wherein R represents an ethylene or propylene group, x and y are each an integer of 1 or more, and the average value of x+y is 2 to 7)

in an amount of not less than 10 mol % and not more than 30 mol % based on the entire monomer content;

(ii) a diol component represented by the general formula (2)

$$OH\text{-}(CH_2)_n\text{-}OH \quad (2)$$

(wherein n is an integer of 2 to 6)

in an amount of not less than 10 mol % and less than 25 mol % based on the entire monomer content;

(iii) a dibasic carboxylic acid, an anhydride thereof or a lower alkyl ester thereof; and (iv) a tribasic or higher polybasic carboxylic acid, an anhydride thereof or a lower alkyl ester thereof in an amount of not less than 2.5 mol % and less than 15 mol % based on the entire monomer content, and 0.01 to 1.5 parts by weight of hydrophobic silica having a pH value of 5.5 to 8 when 4% by weight of said hydrophobic silica is dispersed in a water-methanol solution (1:1) to 100 parts by weight of said toner.

6. A toner composition comprising a binder resin containing a polyester resin as a major component of said binder resin, wherein said polyester resin is obtained by co-condensation polymerization of:

(i) a diol component represented by the general formula (1)

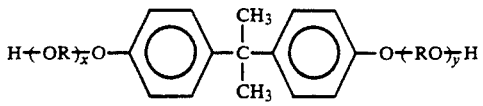

(1)

(wherein R represents an ethylene or propylene group, x and y are each an integer of 1 or more, and the average value of x+y is 2 to 7)

in an amount of less than 10 mol % based on the entire monomer content;

(ii) a diol component represented by the general formula (2)

$$OH\text{-}(CH_2)_n\text{-}OH \quad (2)$$

(wherein n is an integer of 2 to 6)

in an amount of not less than 10 mol % and less than 25 mol % based on the entire monomer content;

(iii) a dibasic carboxylic acid, an anhydride thereof, or a lower alkyl ester thereof; ;and (iv) a tribasic or higher polybasic carboxylic acid, an anhydride thereof, or a lower alkyl ester thereof in an amount of not less than 2.5 mol % and less than 15 mol % based on the entire monomer content, and 0.01 to 1.5 parts by weight of hydrophobic silica having a pH value of 5.5 to 8 when 4% by weight of hydrophobic silica is dispersed in water-methanol solution (1:1) to 100 parts by weight of said toner.

7. A toner composition containing a polyester resin as a major component of a binder resin, wherein said polyester resin is obtained by co-condensation polymerization of:

(i) a diol component represented by the general formula (1)

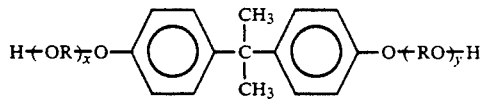

(1)

(wherein R represents an ethylene or propylene group, x and y are each an integer of 1 or more, and the average value of x+y is 2 to 7)

in an amount of less than 10 mol % based on the entire monomer content;

(ii) a diol component represented by the general formula (2)

$$OH\text{-}(CH_2)_n\text{-}OH \quad (2)$$

(wherein n is an integer of 2 to 6)

in an amount of not less than 10 mol % and less than 25 mol % based on the entire monomer content;

(iii) a dibasic carboxylic acid, an anhydride thereof, or a lower alkyl ester thereof;

(iv) a tribasic or higher polybasic carboxylic acid, an anhydride thereof, or a lower alkyl ester thereof in an amount of not less than 2.5 mol % and less than 15 mol % based on the entire monomer content; and (v) a diol component represented by the general formula (3)

$$OH\text{-}(R'O)_n\text{-}OH \quad (3)$$

(wherein R' represents an alkylene group having a carbon number of 2 to 4 and n is an integer of 2 to 4)

in an amount of not less than 1.5 mol % and less than 10 mol % based on the entire monomer content, and 0.01 to 1.5 parts by weight of hydrophobic silica having a pH value of 5.5 to 8 when 4% by weight of said hydrophobic silica is dispersed in a water-methanol solution (1:1) to 100 parts by weight of said toner.

8. A toner composition containing a polyester resin as a major component of a binder resin, wherein said polyester resin is obtained by co-condensation polymerization of:

a linear or branched polyester having a number-average molecular weight of 300 to 1400, a tribasic or higher polybasic carboxylic acid or a derivative thereof and/or a trihydric or higher polyhydric alcohol, wherein a diol component represented by the general formula (2):

$$OH\text{-}(CH_2)_n\text{-}OH \quad (2)$$

(wherein n is an integer of 2 to 6)

is used as a dihydric alcohol in an amount of not less than 10 mol % and less than 25 mol % based on the entire monomer content, and 0.01 to 1.5 parts by weight of hydrophobic silica having a pH value of 5.5 to 8 when 4% by weight of said hydrophobic silica is dispersed in a water-methanol solution (1:1) to 100 parts by weight of said toner.

9. A toner composition according to claim 1, wherein said hydrophobic silica has a pH value of 5.5 to 8 when 4% by weight of said hydrophobic silica is dispersed in a water-methanol solution (1:1).

10. A toner composition according to claim 2, wherein said hydrophobic silica has a pH value of 5.5 to 8 when 4% by weight of said hydrophobic silica is dispersed in a water-methanol solution (1:1).

11. A toner composition according to claim 3, wherein said hydrophobic silica has a pH value of 5.5 to 8 when 4% by weight of said hydrophobic silica is dispersed in a water-methanol solution (1:1).

12. A toner composition according to claim 4, wherein said hydrophobic silica has a pH value of 5.5 to 8 when 4% by weight of said hydrophobic silica is dispersed in a water-methanol solution (1:1).

13. A toner composition according to claim 1, wherein said hydrophobic silica is obtained by a treatment with hexamethyldisilazane to increase said degree of hydrophobic property.

14. A toner composition according to claim 2, wherein said hydrophobic silica is obtained by a treatment with hexamethyldisilazane to increase said degree of hydrophobic property.

15. A toner composition according to claim 3, wherein said hydrophobic silica is obtained by a treatment with hexamethyldisilazane to increase said degree of hydrophobic property.

16. A toner composition according to claim 4, wherein said hydrophobic silica is obtained by a treatment with hexamethyldisilazane to increase said degree of hydrophobic property.

17. A toner composition according to claim 5, wherein said hydrophobic silica is produced by a treatment with hexamethyldisilazane to increase said degree of hydrophobic property.

18. A toner composition according to claim 6, wherein said hydrophobic silica is produced by a treatment with hexamethyldisilazane to increase said degree of hydrophobic property.

19. A toner composition according to claim 7, wherein said hydrophobic silica is produced by a treatment with hexamethyldisilazane to increase said degree of hydrophobic property.

20. A toner composition according to claim 8, wherein said hydrophobic silica is produced by a treatment with hexamethyldisilazane to increase said degree of hydrophobic property.

* * * * *